US006951317B2

(12) United States Patent
Woessner et al.

(10) Patent No.: US 6,951,317 B2
(45) Date of Patent: Oct. 4, 2005

(54) VEHICLE, LIGHTWEIGHT PNEUMATIC PILOT VALVE AND RELATED SYSTEMS THEREFOR

(75) Inventors: George T. Woessner, Phoenix, AZ (US); Stephen G. Abel, Chandler, AZ (US); Mark H. Baker, Scottsdale, AZ (US); Dennis M. Alexander, Mesa, AZ (US)

(73) Assignee: Honeywell International Inc., Morristown, NJ (US)

( * ) Notice: Subject to any disclaimer, the term of this patent is extended or adjusted under 35 U.S.C. 154(b) by 31 days.

(21) Appl. No.: 10/234,697

(22) Filed: Sep. 3, 2002

(65) Prior Publication Data

US 2004/0041058 A1 Mar. 4, 2004

(51) Int. Cl.[7] ..... F42B 15/01; F41G 7/00

(52) U.S. Cl. ..... 244/3.22; 244/3.1; 244/3.15; 244/3.21; 244/164; 60/233

(58) Field of Search ..... 60/233; 244/158 R, 244/164

(56) References Cited

U.S. PATENT DOCUMENTS

| | | | | | |
|---|---|---|---|---|---|
| 3,116,047 | A | | 12/1963 | Andersen, Jr. | 251/123 |
| 3,304,723 | A | * | 2/1967 | Gaura | 60/233 |
| 3,446,474 | A | | 5/1969 | Diver | 251/141 |
| 3,677,011 | A | * | 7/1972 | Vickland | 60/254 |
| 3,709,460 | A | * | 1/1973 | McIntoch | 251/11 |
| 3,721,402 | A | * | 3/1973 | Holland | 244/3.22 |
| 3,780,763 | A | * | 12/1973 | Wisniewski | 251/43 |
| 3,826,278 | A | * | 7/1974 | Lovingham et al. | 251/347 |
| 3,971,542 | A | * | 7/1976 | Lee, II | 251/58 |
| 4,023,355 | A | * | 5/1977 | McDonald | 60/254 |
| 4,085,909 | A | * | 4/1978 | East et al. | 244/3.21 |
| 4,390,157 | A | | 6/1983 | Meckstroth | 251/30 |
| 4,424,670 | A | * | 1/1984 | Calabro | 60/231 |
| 4,424,679 | A | * | 1/1984 | Holzman | 60/251 |
| 4,428,194 | A | | 1/1984 | Stokes et al. | 60/39.02 |
| 4,445,532 | A | | 5/1984 | Mitchell | 137/495 |
| 4,458,718 | A | | 7/1984 | Vick | 137/505 |
| 4,553,474 | A | | 11/1985 | Wong et al. | 98/1.5 |
| 4,553,735 | A | | 11/1985 | Brundage | 251/129.16 |
| 4,696,160 | A | * | 9/1987 | Gat | 60/258 |
| 4,712,747 | A | * | 12/1987 | Metz et al. | 244/3.22 |
| 4,768,555 | A | | 9/1988 | Abel | 137/627.5 |
| 4,779,821 | A | | 10/1988 | Sutton | 244/52 |
| 4,826,104 | A | * | 5/1989 | Bennett et al. | 244/3.22 |
| 4,930,541 | A | | 6/1990 | Solberg | 137/875 |
| 4,964,422 | A | | 10/1990 | Ball et al. | 137/512.1 |
| 4,964,431 | A | | 10/1990 | Ball et al. | 137/1 |
| 4,967,778 | A | | 11/1990 | Ball et al. | 137/1 |
| 4,991,393 | A | * | 2/1991 | Otten et al. | 60/204 |
| 5,000,213 | A | | 3/1991 | Tervo et al. | 137/1 |
| 5,005,804 | A | | 4/1991 | Andersen et al. | 251/215 |
| 5,029,599 | A | | 7/1991 | Ball | 137/1 |
| 5,067,506 | A | | 11/1991 | Ball et al. | 137/1 |

(Continued)

*Primary Examiner*—Bernarr E. Gregory
(74) *Attorney, Agent, or Firm*—Ingrassia Fisher & Lorenz

(57) ABSTRACT

A vehicle, such as a missile, with a pilot valve system controls the vehicle's thrust valves despite a hostile propellant gas environment. The pilot valve system can have one or more pilot valves. Using refractory elements, the pilot valve ball reciprocates between a supply seat and a vent seat which is subject to the filtered inflow of propellant thrust gases. When open, the pilot valve allows the stray thrust gas to communicate to a control chamber which closes a poppet against a valve seat in the nozzle. When an associated solenoid closes the pilot valve by pushing the pilot valve ball against the supply seat, the control chamber is vented to ambient. The poppet may then travel into the cylinder bore and the nozzle is opened to exhaust propellant gases and exert lateral thrust on the vehicle. Certain nozzle thrust geometries provide useful vehicle guidance.

42 Claims, 9 Drawing Sheets

U.S. PATENT DOCUMENTS 5,102,097 A 4/1992 Davis et al. ..... 251/283
5,113,910 A 5/1992 Ball ..... 137/630.15
5,334,090 A 8/1994 Rix ..... 454/72
5,351,934 A 10/1994 Jensen et al. ..... 251/65
5,386,848 A 2/1995 Gilchrist et al. ..... 137/510
5,404,791 A 4/1995 Kervagoret ..... 91/433
5,501,425 A 3/1996 Reinicke et al. ..... 251/129.15
5,520,578 A 5/1996 Bloch et al. ..... 454/74
5,577,263 A 11/1996 West
5,590,852 A 1/1997 Olson
5,619,851 A * 4/1997 Johnson et al. ..... 60/267
5,771,931 A * 6/1998 Watson ..... 251/368
5,899,064 A 5/1999 Cheung
5,927,335 A 7/1999 Christensen
6,006,780 A 12/1999 Tseng et al.
6,068,010 A 5/2000 Reinicke
6,202,674 B1 3/2001 Wingett
6,227,247 B1 5/2001 Abel
6,233,919 B1 5/2001 Abel et al.
6,276,125 B1 8/2001 Tseng
6,289,669 B1 * 9/2001 Smirra ..... 60/229
6,308,723 B1 10/2001 Louis et al.
6,488,237 B1 * 12/2002 Glasser et al. ..... 244/172
6,589,385 B2 * 7/2003 Minami et al. ..... 156/345.19

* cited by examiner

VEHICLE, LIGHTWEIGHT PNEUMATIC PILOT VALVE AND RELATED SYSTEMS THEREFOR

CROSS-REFERENCES TO RELATED APPLICATIONS

This patent application is related to U.S. patent application Ser. No. 10/216,622 filed on Aug. 9, 2002 entitled Missile Thrust System And Valve With Refractory Piston Cylinder, and is incorporated herein by reference.

This patent application is related to U.S. patent application Ser. No. 10/138,090 filed May 3, 2002, now U.S. Pat. No. 6,773,663 entitled Oxidation and Wear Resistant Rhenium Metal Matrix Composite; U.S. patent application Ser. No. 10/138,087 filed May 3, 2002 entitled Oxidation Resistant Rhenium Alloys; U.S. Provisional Patent Application Ser. No. 60/384,631 filed May 31, 2002 entitled Use of Powdered Metal Sintering/Diffusion Bonding to Enable Applying Silicon Carbide or Rhenium Alloys to Face Seal Rotors; and U.S. Provisional Patent Application Ser. No. 60/384,737 filed May 31, 2002 entitled Reduced Temperature and Pressure Powder Metallurgy Process for Consolidating Rhenium Alloys, which are all incorporated herein by reference.

STATEMENT AS TO RIGHTS TO INVENTIONS MADE UNDER FEDERALLY-SPONSORED RESEARCH AND DEVELOPMENT

The U.S. Government may have certain rights in this invention, which was developed under contract no. F08630-99-C-0027 awarded by the Air Force Research Lab/AFRL.

BACKGROUND OF THE INVENTION

1. Field of the Invention

This invention relates to missile control or other vehicle control technology, more particularly to a missile with a lightweight pneumatic pilot valve for controlling a main valve generally via diversion of propellant thrust.

2. Description of the Related Art

Self-propelled vehicles, including missiles and the like, are generally propelled by a main engine exerting thrust rearwardly to propel the missile through a medium, such as air. The same can be said for underwater missile technology, as well as torpedoes. The use of a single engine generally means that the rearward thrust is precisely aligned with the vehicle's center of gravity. Use of a single main engine generally does not allow for the lateral control of the missile with that engine, especially in solid fuel applications. As used herein, the term "missile" is used to indicate any propelled craft subject to the consideration and constraint as indicated by context.

One way to laterally control a missile is to use side thrusters to control the roll, pitch, and yaw, movements of the missile. These side thrusters can be powered by the same engine propellant as the main rearward-thrust engine. In this arrangement, valves are used to thrust laterally so that the missile can be maneuvered. The greater the precision of the thrust application both rearwardly and laterally, the greater the accuracy of the missile. Such accuracy is of great advantage with respect to both military and possibly civilian applications.

Missile technology can be used to deliver a weapons payload for military purposes or a civilian payload for other purposes, such as to quickly deliver rescue materials to isolated locations. Missiles can deliver such payloads very rapidly and very accurately with the proper attitude control.

Pneumatic pilot valves can be used for control of the main lateral thrust valves to provide means by which these lateral thrust valves can be operated. High temperature divert and attitude control valves for missiles and spacecraft can use one or more pilot stages to achieve fast response in high mass flow valves. In certain applications, such as solid fueled rockets and missiles, pilot valves usually have small flow passages and elements that are sensitive to erosion and contamination from condensables arising from the hot gases produced by the solid propellant gas generators. In order to resolve the demands for better missile and craft technology, the present invention provides a better solution to the demand and need for missile pilot valves such as those that control lateral thrusting.

In addition to the difficulties posed by valves, solid fuel missiles in general with diameters of less than roughly 30 inches have had to depend upon fins to guide the missile. Larger missiles and rockets have used thrust diversion valves in place of fins for guidance. However, conventional thrust valves are of the size and weight that would make them impractical to use for guidance in place of fins on such smaller vehicles having solid fuel and associated high temperature operating environments. This is especially so in the area of solid fueled tactical missiles, which may have a diameter of 10 inches or less.

In view of the foregoing, a need exists for a cost effective, lightweight, pneumatic pilot valve capable of withstanding the corrosive, erosive, and other effects of hot gases produced from solid propellant gas generators. Additionally, there is also a need for a main lateral thrust control valve that sufficiently seals the lateral thrust nozzle when off or inactive yet is able to operate quickly and reliably when needed. The present invention satisfies one of more of these needs.

SUMMARY OF THE INVENTION

The present invention provides a missile craft with a new, robust, lightweight, and relatively inexpensive pneumatic pilot valve to operate a main thrust valve in a reliable and predictable manner enabling the better targeting and operation of the associated missile craft.

The general purpose of the present invention is to provide pilot valves with improved capabilities as well as providing an advantageous poppet and valve seat design in an integrated fashion with many novel features that result in pilot valves, poppet valves, and an integrated design combining the two.

By way of example only, one embodiment of the present invention includes a lightweight composite pilot valve using refractory metal valve elements in a two stage vent design that is generally insensitive to contaminants and capable of operating under high temperature (5000° F.) conditions for short duty cycles. The pilot valve set forth herein integrates refractory valve elements with composite plastic housing structures to provide a low cost and lightweight pilot valve that controls the hot gases produced from solid propellant gas generators. A porous filter screens hot gas for particulates and condensables prior to entry into the valve. Such particulates and condensables could interfere with the operation of the pilot valve due to the close tolerances used therein. The refractory metal ball shuttles between two opposing conical refractory valve seats which are trapped between fiber-reinforced ablative phenolic housings or otherwise that may be sealed with high density exfoliated graphite gaskets. A refractory pintel is affixed to an electric solenoid plunger extending through the aperture of one of the valve seats. The pintel shuttles the ball between the seats to generally provide bistable control for the pilot valve.

In one embodiment of the valve, the pilot valve redirects thrust to control the thrust valve by allowing and preventing thrust gases to seat or unseat a main valve from its valve seat. The pilot valve has a supply valve seat and a vent valve seat to define a valve chamber. The supply valve seat defines a thrust emit opening while the vent valve seat defines a pressure vent opening. A valve gate is selectively moveable between the supply valve seat and the vent valve seat in order to selectively open or close the thrust inlet opening or the pressure vent opening, respectively. The valve chamber is in fluid communication with the thrust emit opening, the associated thrust valve, and the pressure vent opening such that operation of the valve gate in the valve chamber serves to control the flow of fluid through the valve chamber. The valve gate is subject to a valve gate control mechanism operably coupled to the valve gate. In this way, when the valve gate is seated in the vent valve seat, thrust pressure is applied to the thrust valve. The thrust then ceases when the valve gate is seated in the supply seat and any residual thrust pressure present in or on the thrust valve is vented through the pressure vent.

In one detailed embodiment, the pilot ball may divert hot gas between the control volume of a second stage valve and a two-stage ambient vent. The two-stage vent, in conjunction with the insulative properties and ablative characteristics of plastic composite materials, generally prevents pressurization and overheating of the solenoid. The housings employed generally use reinforced composites for structural valve elements. The resulting pilot valve can withstand the hostile and high temperature environment generated by the combustion of solid propellant and can take the resulting blast of thrust gases in order to provide reliable operation of the associated lateral thrust valve.

In addition to the pilot valve of the present invention, a novel valve system is disclosed herein using a flat poppet in conjunction with a novel nozzle seat design. In conjunction with the pilot valve disclosed herein, the resulting lateral thrust valve system provides reliable and predictable attitude control for missiles and other propelled craft in a cost efficient and generally-achievable design.

By way of example only, one embodiment of the invention is related to a thrust valve system for solid fuel missile guidance that is enclosed in the missile's housing, which is less than 30 inches in diameter. The missile thus would not need fins as its primary steering mechanism. In more detailed aspects of the invention, the missile could have a diameter of less than 10 inches or even less than 7 inches, to provide for air launches by aircraft or to fit in other small launching systems on space, air, ground, or sea vehicles. In one preferred embodiment, six thrust valves are used and located within the body of the missile adjacent to its main propellant exhaust port.

Other features and of the present invention will become apparent from the following description of the preferred embodiment(s), taken in conjunction with the accompanying drawings, which illustrate, by way of example, the principles of the invention.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The invention is embodied in a pilot valve 100. By providing a pilot valve system that can withstand the operating conditions of generally-adjacent missile thrust from solid propellant, the pilot valve 100 provides a significantly more useful pilot valve and control system for thrust nozzles, especially thrust nozzles exerting lateral control over the missile. As used herein, the term "missile" is intended to mean all thrust-propelled craft susceptible to the present invention including spacecraft, torpedoes, missiles. In addition, the pilot valve can be used in other unrelated applications for expanding gas technology, including air bag systems for automobiles.

Figure 1:
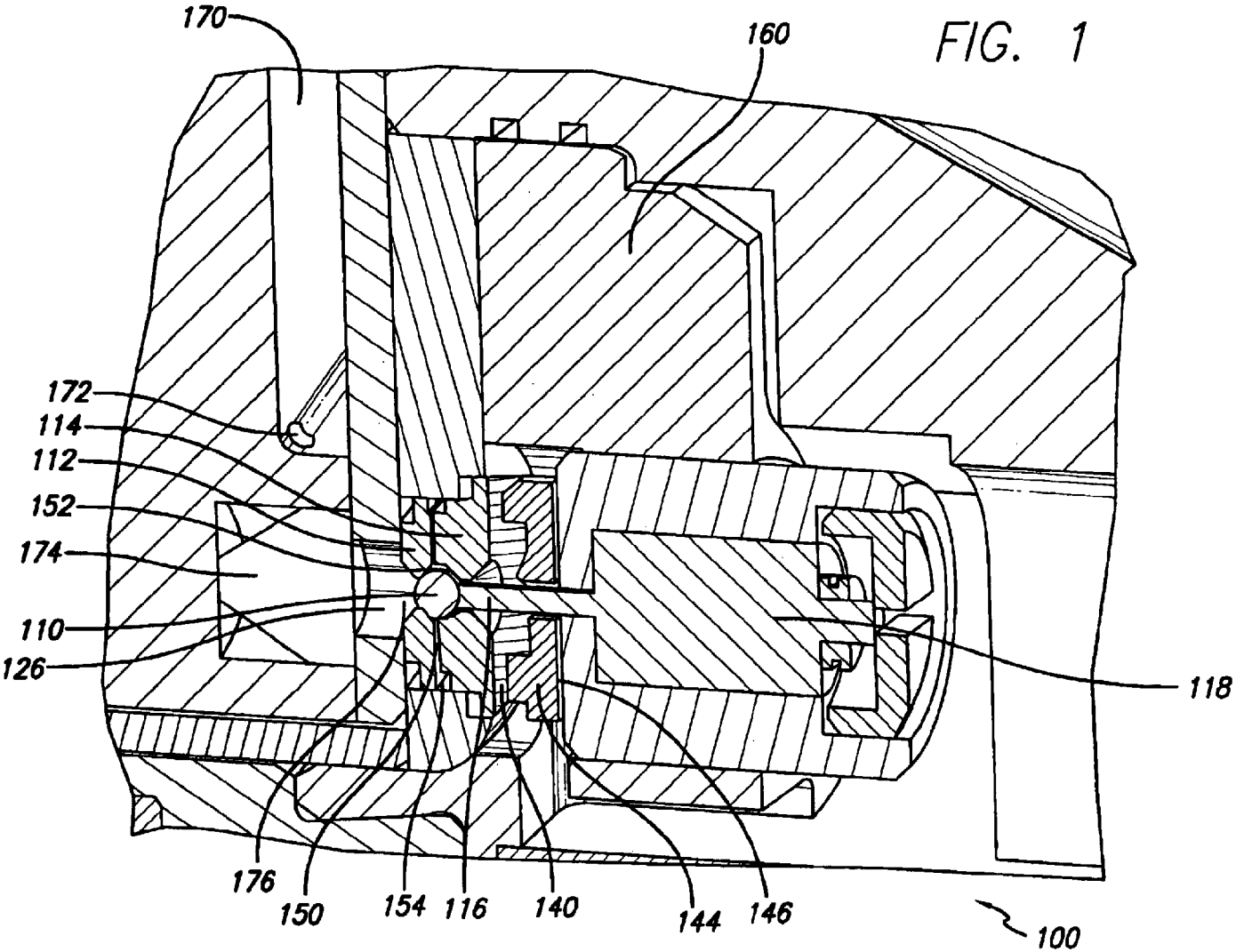
FIG. 1 is a one-half cross sectional view of the pilot valve and accompanying chambering channel system used in the present invention.

FIG. 1 shows in a half cross section the pilot valve 100. The pilot valve 100 controls the application of propellant gas to the control chamber 102 (FIG. 3) for the piston/poppet 104 which, in turn, controls the outward thrust through the nozzle 106. When the pilot valve 100 is in an open position, gas is able to flow through the pilot valve and into the control chamber 102. When the pilot valve is off (occurring when it is energized) the pressure exerted on the piston/poppet 104 in the control chamber 102 is eliminated and the pilot valve 100 opens a vent to release the pressure formerly present in the control chamber. The poppet 104 then descends into the control chamber 102 to open up the nozzle 106 and allow thrust to pass therethrough.

Figure 2:
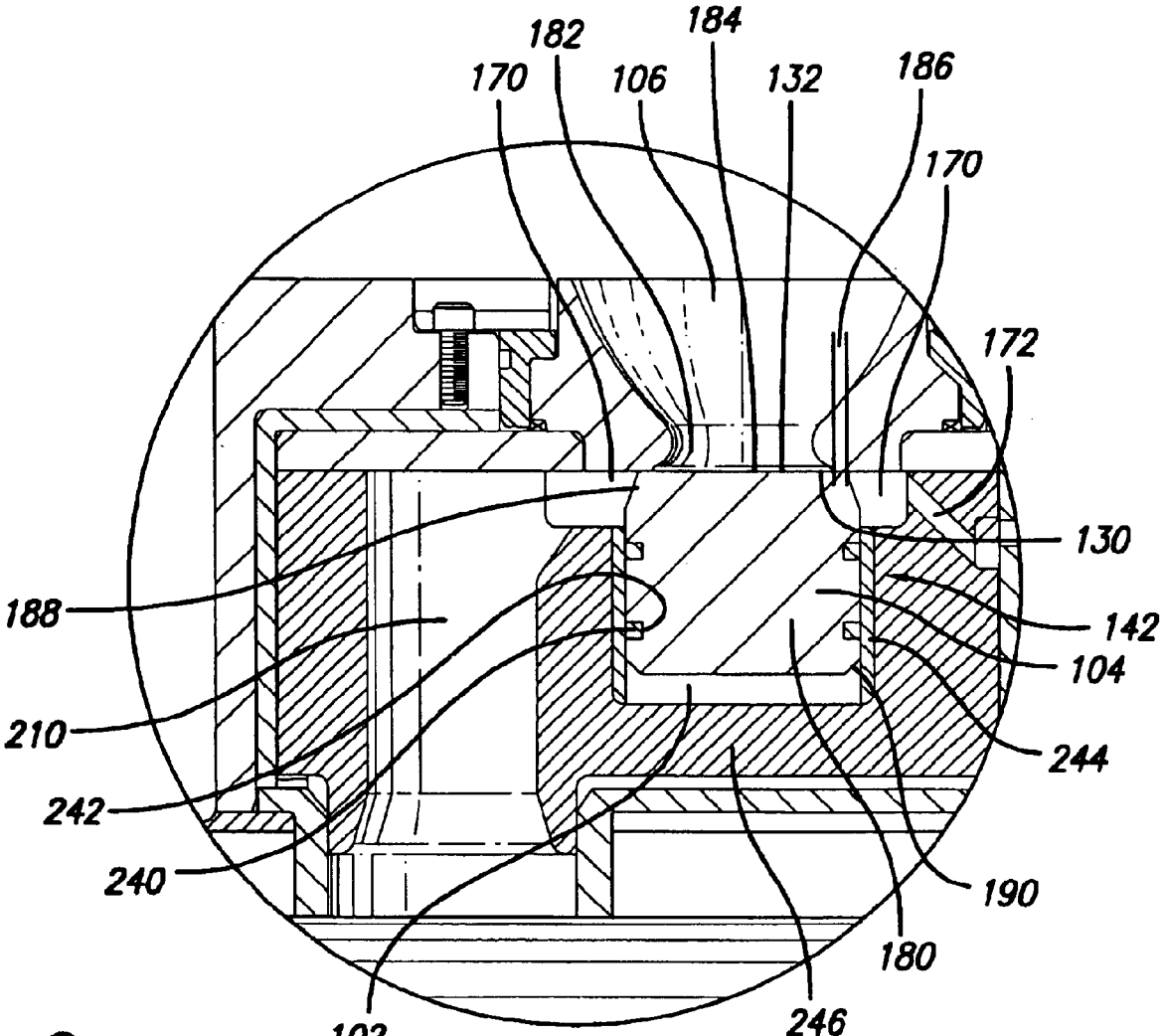
FIG. 2 is a half cross section of the lateral thrust valve system associated with the pilot valve of the present invention.
Figure 5:
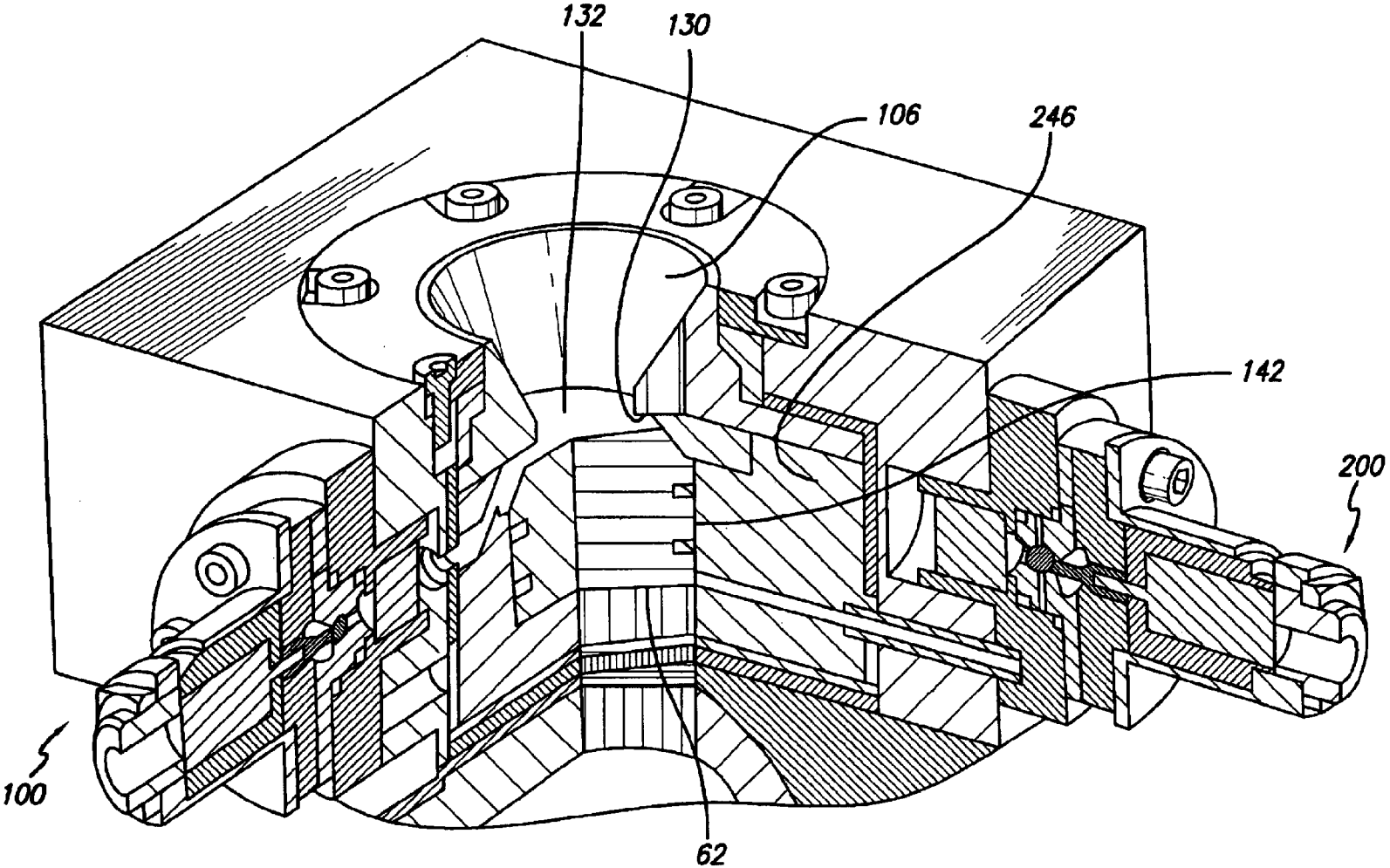
FIG. 5 is a side quarter-section cross sectional view of one embodiment of the present invention using both hot and cold gas pilot valves.
Figure 6:
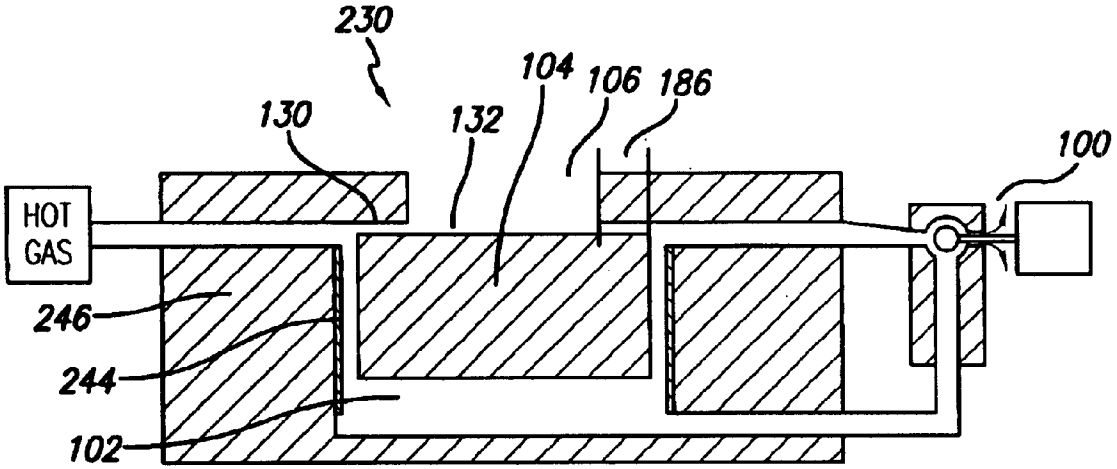
FIG. 6 is a cross sectional diagram of the valve system shown in FIG. 4 with the hot and cold gas pilot valves.

FIGS. 2, 3, 5, and 6 all show the poppet 104 with FIGS. 2 and 6 showing particularly the control chamber 102. One of the primary concerns with respect to the pilot valve 100 is the operating conditions under which it must function, which includes a solid propellant system for the associated vehicle. Solid propellant gas thrust is extremely hot, corrosive and/or erosive, and may contain condensables or particulates that may interfere with the proper operation of machinery, such as the pilot valve 100, which must operate with very close tolerances. The hot gas creates difficulties with respect to thermal expansion as a variety of materials may be used in the pilot valve 100 each of which may expand differently when subject to the same change in temperature. Consequently, due to the importance of proper operation of the pilot valve 100 as well as the difficult operating circumstances under which it must act, the particular embodiments set forth herein are believed to provide a more reliable and capable design for such pilot valves. Additionally, the importance for missile or other craft guidance is significant as generally such craft rely upon their own thrust systems once they are launched, as such craft are generally self-contained.

Beginning with FIG. 1, the pilot valve 100 has a rhenium pilot valve ball 110 which reciprocates between a rhenium supply seat 112 and a rhenium vent seat 114. Rhenium is used for these main operating elements of the pilot valve 100 as rhenium is a refractory metal that can generally withstand the high operating temperatures of the propellant gas. Other refractory or high-temperature-withstanding materials may also be used in the place of rhenium, including rhenium alloys as well as tungsten, molybdenum, tantalum, niobium, and/or alloys of these or other refractory metals or substances now known or later developed. However, rhenium is currently seen as a preferred material for the rhenium ball 110 and the supply and vent seats 112, 114.

An armature plunger 116 couples the rhenium pilot valve ball 110 to the solenoid 118. The solenoid is operated by a flight computer or otherwise and causes the rhenium valve ball poker 110 to move from the vent seat 114 to the supply seat 112. By default, the solenoid is not energized and the ball poker 110 and armature plunger 116 (which may also be made of rhenium or other refractory material) is able to travel into the solenoid as by the pressure from the supply gas. The pilot valve ball 110 then seats itself against the vent seat 114, sealing the associated control chamber 102 from vents present in association with the pilot valve 100. The vents are described in greater detail below.

When the pilot valve ball 110 seats itself against the vent seat 114, the supply seat 112 is open and incoming gas applies pressure throughout the chamber system present on the other side of the supply seat 112. This includes passageways to the control chamber 102 as well as the control chamber 102 itself. The pressure from the incoming gas pushes the poppet 104 upwards against the nozzle seat 130 and the flat face 132 closes off the nozzle 106 by pressing against the nozzle seat 130. More about the operation of the poppet 104 is set forth in detail below.

The poppet 104 is maintained in an upper position closing the nozzle 106 so long as the pilot valve ball 110 is not seated on the supply seat 112 as when it is generally seated on the vent seat 114.

In order to activate the nozzle 106, the pilot valve 100 closes the supply seat 112 by activating the solenoid 118. When the solenoid 118 is activated, the armature plunger 116 is forced outwardly from the solenoid 118. This causes the pilot valve ball 110 to travel from the vent seat 114 to the supply seat 112, thus closing the supply seat 112 to the entry of incoming gas as well as enabling the opening of the vent seat 114 and the accompanying vent passageways.

The closure of the supply seat 112 cuts off the incoming gas and its associated pressure. The pressure then present in the control chamber 102 would be maintained thus keeping the nozzle 106 closed save for the ventilation system present in the pilot valve 100.

Upon moving away from the vent seat 114, the pilot valve ball 110 opens up a ventilation system enabling compressed gas and other pressure-exerting influences to escape from the control chamber 102 past the pilot valve ball 110 and through the vent seat 114.

The tolerances and clearances between the armature plunger 116 and the opening of the vent seat 114 are very close. Consequently, the ability to vent clean gas without the presence of occlusive or obstructing particles is significant to the proper operation and closing of nozzle 106. If a particle were to lodge between the pilot valve ball 110 and the vent seat 114, the vent seat might be held open, and incoming gas could be ventilated through the ventilation system (set forth below) and prevent the full possible pressure of the gas from being exerted upon the underside of the poppet 104.

The close fit between the armature plunger 116 and the radial vent slot 140 (circumscribing the armature plunger 116 just past the vent seat 114) may provide some back pressure against the poppet 104 in order to cushion the poppet's downward travel into the nozzle valve cylinder 142. Despite the narrow opening of the radial vent slots due to this close fit, the gas is generally still very hot and could injure the solenoid 118 upon its exit through the vent seat 114. In order to prevent or inhibit injury to the solenoid 118, a vent housing 144 is used to protect the solenoid 118. The vent housing 144 aids in reducing the vent pressure to ambient before the released thrust gasses engage the unsealed armature of the solenoid 118. Because the solenoid 118 of the pilot valve is not protected or sealed from the supply gas (gas), the solenoid is considered a "wet" solenoid as opposed to a "dry" solenoid.

Figure 9:
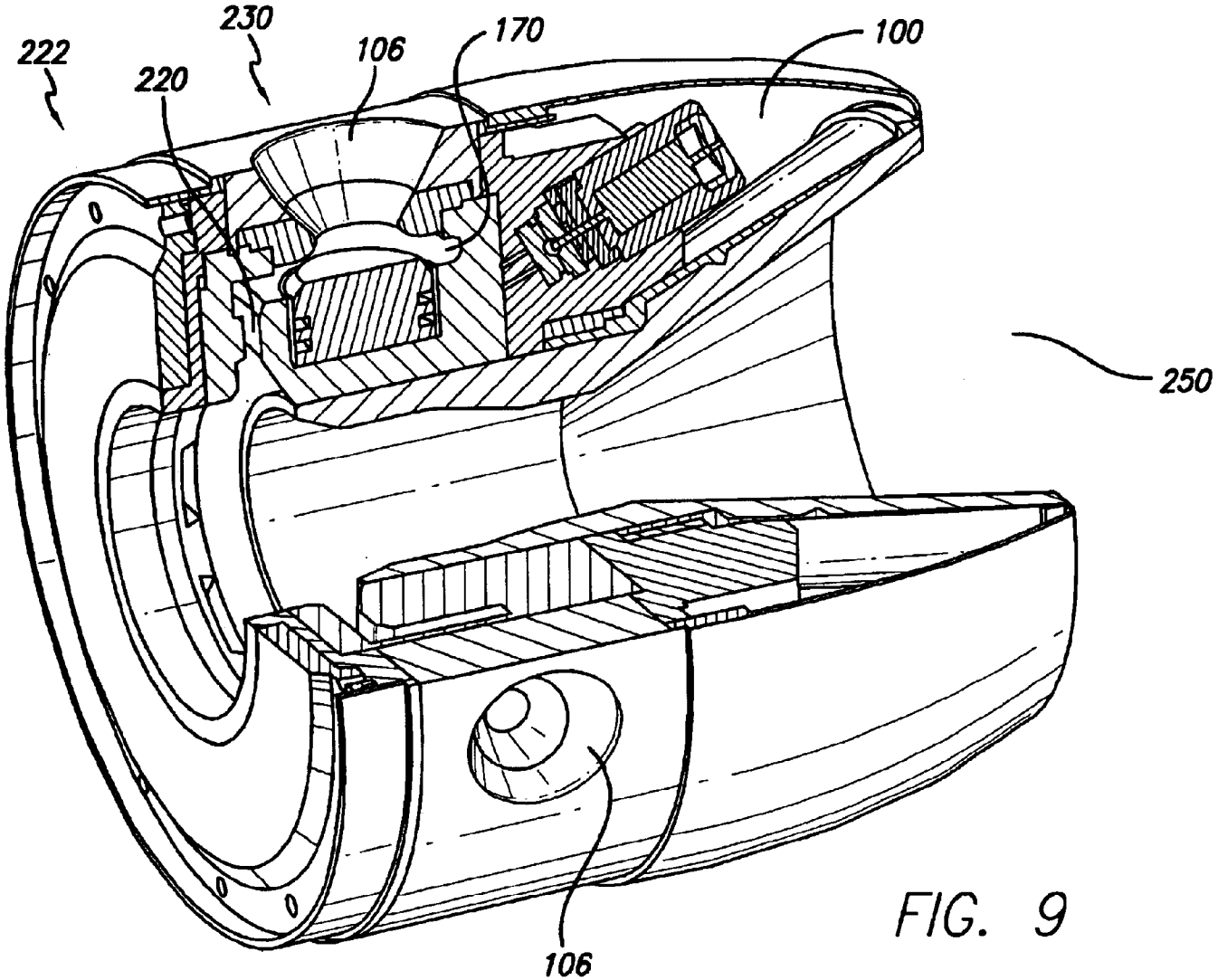
FIG. 9 is a side perspective and quarter cross sectional view of a tail section of a missile incorporating the pilot valve and lateral thrust valve system of the present invention in a radial configuration.

The vent housing 144 defines the primary radial vent slots 140 between itself and the vent seat 114. The vent housing 144 defines secondary vent slots 146 between the vent housing 144 and the solenoid 118. These secondary vent slots 146 guide the hot gas away from the solenoid 118. In this way, the pilot valve 100 controls the operation of the nozzle 106 by exerting control over the poppet 104 and its disposition with respect to the nozzle seat 130. The gasses vented through the vent seat 114 and guided through the vent slots 140, 146 may be exhausted through the rear of the craft (FIG. 9).

In order to provide equal distribution of pressure from the gas or otherwise, the supply seat 112 and vent seat 114 define between them a radial control port slot 150 which communicates from the central pilot valve chamber 152 to a control flow annulus 154. The control flow annulus then communicates with the control chamber 102 via ductwork, quills, or otherwise. The use of a radial control port slot 150 enables a very thin cross section to be distributed over a wider space to allow the transmission of gas from the pilot valve chamber 152 to the control flow annulus 154 and onto the control chamber 102. This allows the passageway for pneumatic conduction from the pilot valve chamber 152 to the control chamber 102 to take up less space and to make more efficient the use of space inside the tail cone section or otherwise in a thrust propelled craft. Exfoliated graphite gaskets may be used between the refractory rhenium supply and vent seats 112, 114 and the insulating or housing elements in which the pilot valve 100 of the present invention is set.

Generally, a titanium or other motor closure 160 provides a basic structural element to which the other parts of the missile, such as the pilot valve 100, may be attached. Insulating with housing phenolic or other materials may then be used to fill empty space, provide ductwork, quills, or structure to which the other operating elements of the missile control systems may be attached. Carbon-carbon or other composite materials may be used in order to provide a housing for the pilot valve 100 and/or the poppet 104 and entire nozzle 106.

In one embodiment, gas enters the pilot valve 100 via a valve supply annulus 170 that circumscribes the top of the poppet 104 when the poppet 104 is closed. Gas enters the valve supply annulus 170, passes past the top of the poppet 104 and into a pilot valve supply port 172. The pilot valve supply port 172 transmits the gas and its accompanying pressure to a porous filter 174. The porous filter filters out condensables and particulates from the gas so that they do not interfere with the operation of the pilot valve 100. After passing through the porous filter 174, the thrust then enters the pilot valve inlet 176 and depending upon the position of the pilot valve ball 110, through the supply seat 112 and into the control chamber 102.

In operation, the solenoid 118 is energized and de-energized at a rapid rate when the nozzle 106 is to be operated. This generally provides a bistable control for the pilot valve ball 110 and allows the poppet 104 to oscillate rapidly within the confines of the nozzle valve cylinder 142. By providing short bursts of thrust, the attitudinal control of the associated missile is subject to accurate adjustment and may provide better directional control than continuous operation of the nozzle 106.

The nozzle 106 and its associated poppet/piston 104 operate in conjunction to control the lateral emission of thrust gases through the nozzle 106. The poppet 104 generally travels or oscillates coaxially with the nozzle 106 inside a rhenium sleeve-lined nozzle valve cylinder 142. The construction and operation of a rhenium sleeve-lined nozzle valve cylinder 142 is set forth in U.S. patent application Ser. No. 10/216,622 filed on Aug. 9, 2002 entitled Missile Thrust System And Valve With Refractory Piston Cylinder, and is incorporated herein by reference. The use of a rhenium-lined sleeve in the nozzle valve cylinder 142 provides for greater and more reliable and predictable operation of the poppet 104 and consequently better control of the thrust through the nozzle 106.

The flat poppet face 132 is generally circular in nature and has a diameter that is coaxial with the body of the poppet 104. The diameter of the flat poppet face 132 is generally smaller than that of the main poppet body 180 but is generally larger than the diameter of the nozzle 106 at its closest point to the poppet 104 when the poppet 104 seats against the nozzle 106. The throat 182 of the nozzle 106 has an even smaller diameter than the inlet mouth 184 which is sealed by the poppet 104. An annular region having a width indicated by reference number 186 in FIG. 2 generally circumscribes the nozzle inlet mouth 184 which provides a significant measure of assurance that the nozzle 106 will be closed when the poppet 104 seats itself against the nozzle inlet mouth 184. The beveled top 188 of the poppet 104 may enable it to better cut off the flow of thrust when the control chamber 102 is pressurized. Additionally, the beveled base 190 of the poppet 104 may enable the poppet 104 to better lift off from the bottom of the nozzle valve cylinder 142 when the control chamber 102 is pressurized as incoming gas is able to circumscribe the base of the poppet 140 in order to initiate the valve closing process with the outward push of the pressure inside the control chamber 102 overcoming any downward force exerted by the gas passing over the top face 132 of the poppet 104.

Figure 3:
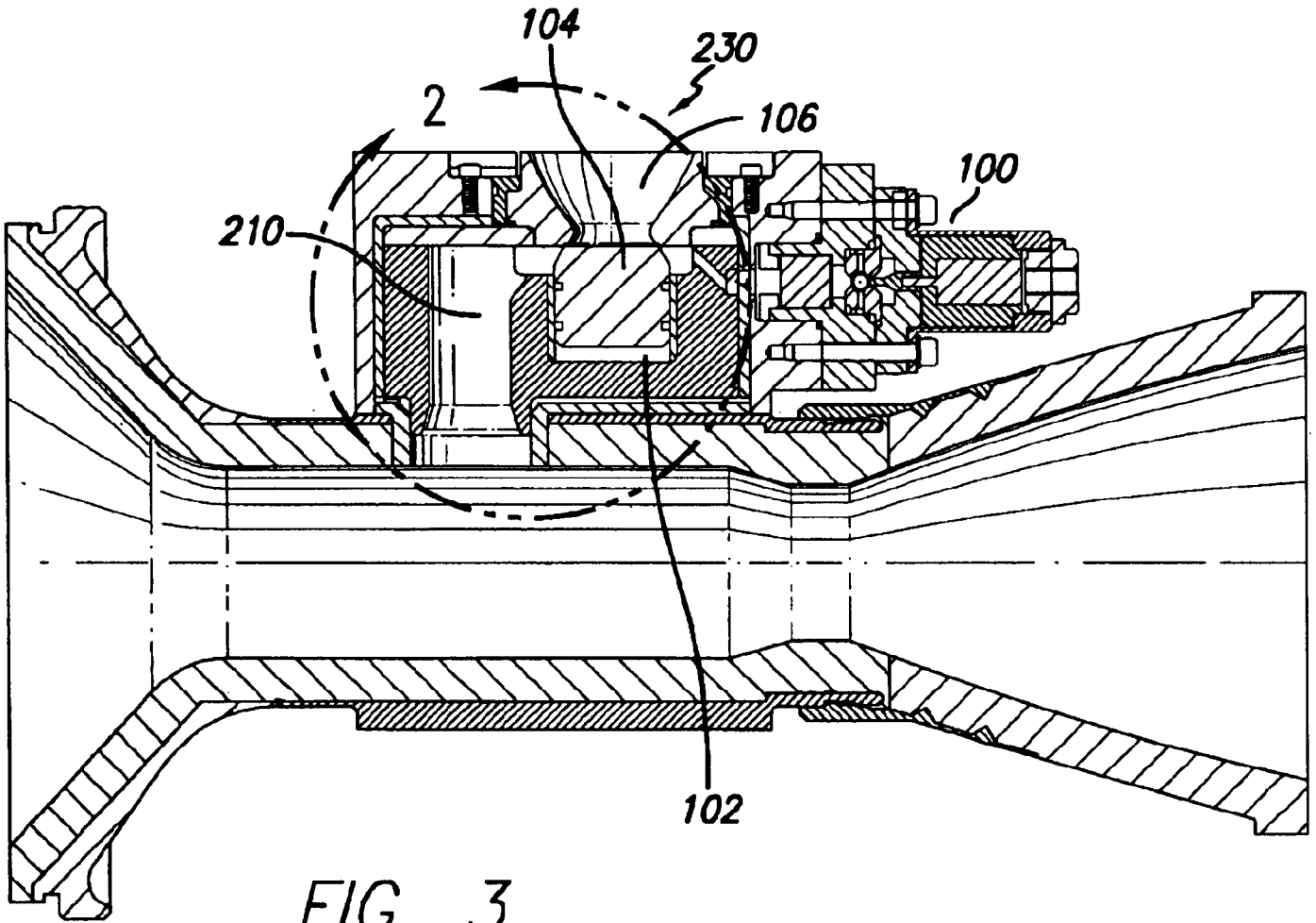
FIG. 3 is a front perspective half section of a solid propellant thrust chamber showing the lateral thrust nozzle in conjunction with the pilot valve.
Figure 4:
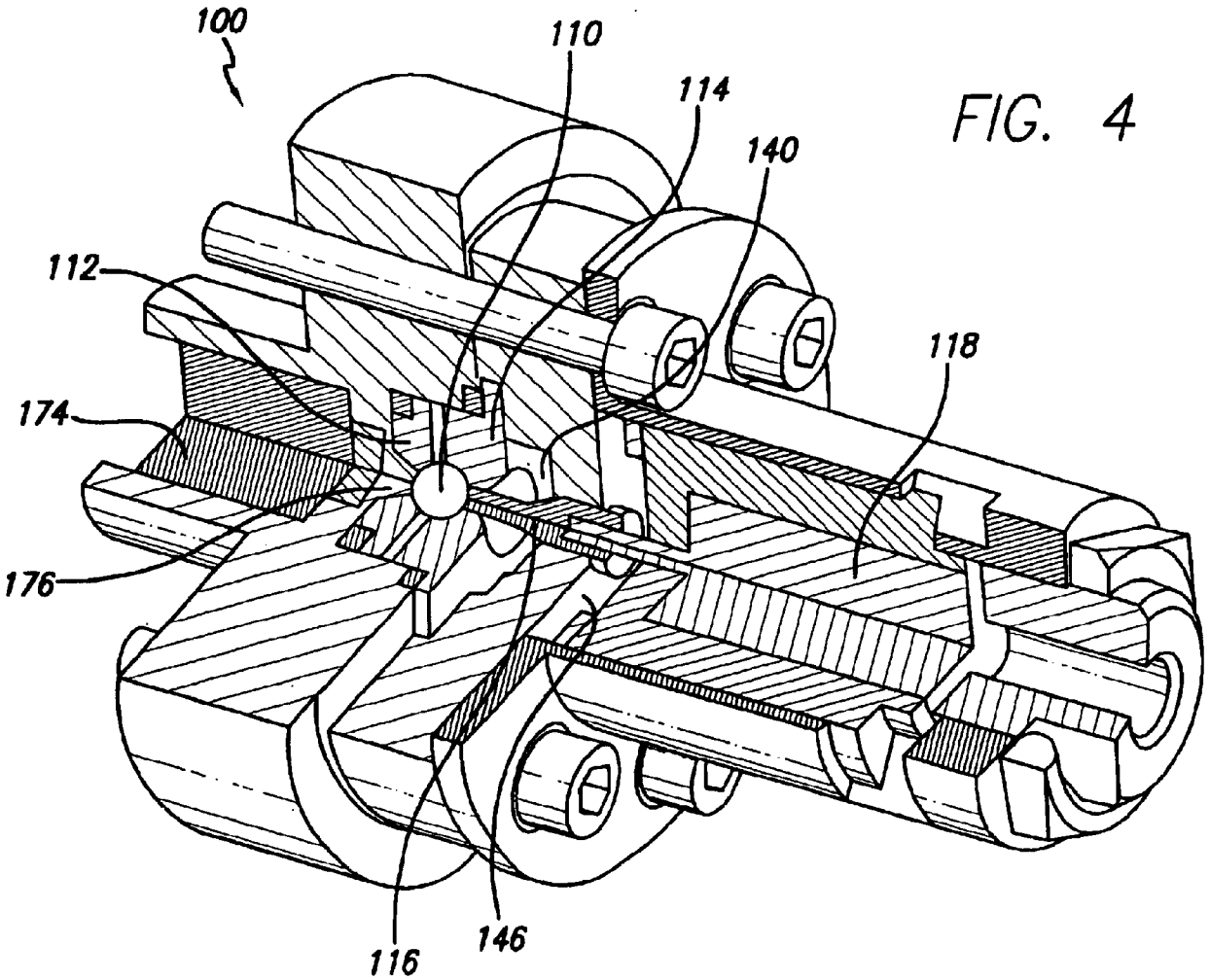
FIG. 4 is a rear side and quarter-section view of the pilot valve of the present invention.

As can be seen in comparing FIGS. 3 and 5, the integrated pilot valve 100 and poppet 104/nozzle 106 configuration provides significant efficiencies for the operation of the nozzle 106. FIG. 6 shows a schematic configuration of a dual pilot valve system which is avoided by the use of a single pilot valve in the present invention. The second pilot valve 200 provides pressurization and ventilation for the control chamber 102 and may use cold gas. The first pilot valve 100 controls hot gas flow across the poppet 104 and into the first pilot valve 100. While the use of two pilot valves is an effective way to control the poppet 104, it is much more efficient in both terms of energy and space to use a single pilot valve that controls the control chamber 102. However, such a configuration is well adapted for testing pilot valves with hot propellant gases and could be used with pilot valve 100.

FIG. 5 shows a test apparatus for conducting experiments using the pilot valve 100 as well as the nozzle 106 and the associated valve system.

In FIG. 2, a main inlet duct 210 conducts thrust gas to the valve supply annulus 170 where it is transmitted to the pilot valve 100 and control chamber 102. The poppet 104 may then be opened and closed according to the operation of the pilot valve 100 and the thrust gas then ejected out the nozzle 106. FIG. 2 shows in detail the nozzle 106 and accompanying poppet 104 as well as the sleeve-lined cylinder 142.

Figure 8:
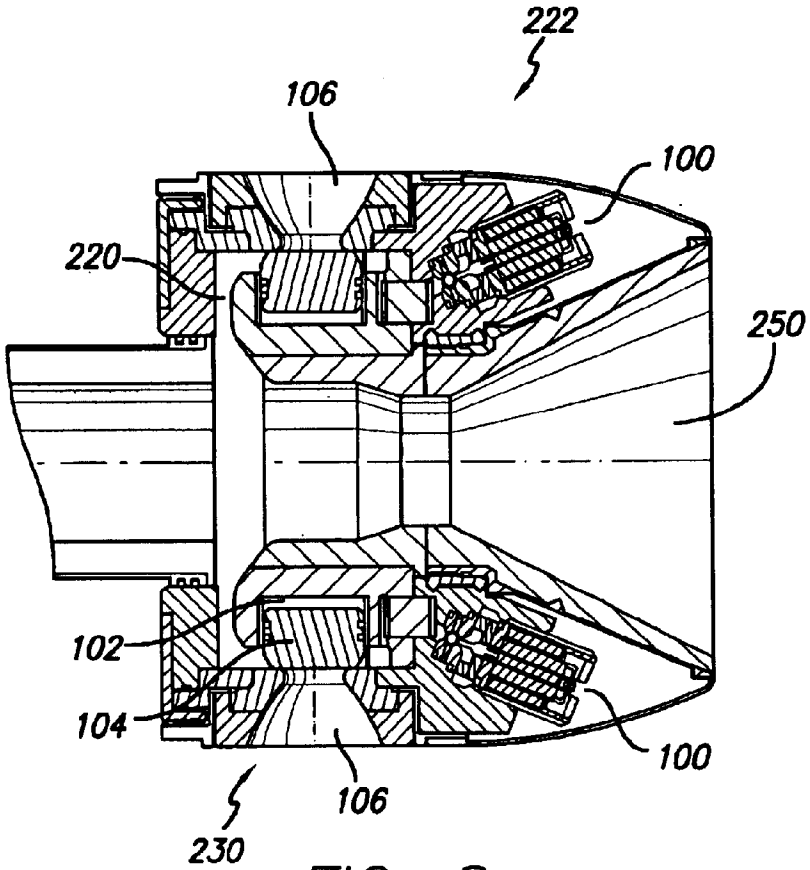
FIG. 8 is a side cross sectional view of the valve geometry shown in FIG. 6.
Figure 7:
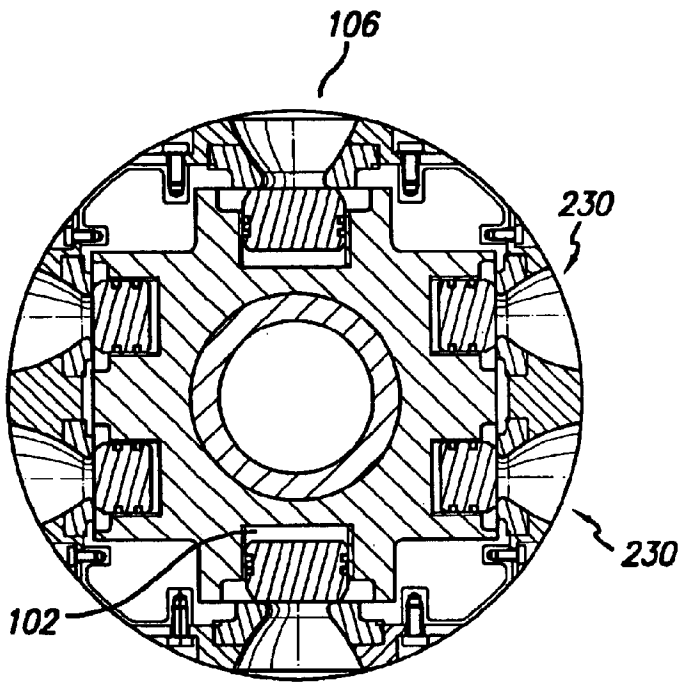
FIG. 7 is an axial cross sectional view of a valve geometry used to control pitch, roll, and yaw.

FIG. 7 and 8 show pertinent cross sections while FIG. 9 shows a quarter cross section of a solid propellant missile or thrust nozzle tail with the nozzles 106 disposed laterally in order to control attitude or thrust vectors. FIG. 7 is an axial cross sectional view of a six nozzle geometry that provides pitch, yaw, and roll control for the associated missile. FIG. 8 is a side cross sectional view of the nozzle geometry of FIG. 7 showing the pitch nozzles 106 and accompanying pilot valves 100. FIG. 9 shows a quarter cross section view of the nozzle configuration shown in FIG. 7 and 8 with both a pitch and a yaw/roll nozzle 106 shown with the pitch nozzle 106 being the one near the top of the drawing while the yaw/roll nozzle 106 being the nozzle near the bottom of the drawing. Of note in FIGS. 8 and 9 is the fact that a thrust supply annulus 220 is present that circumscribes the interior of the tail section 222 which supplies thrust gas to the valve supply annulus 170 and correspondingly the remaining parts of the nozzle/poppet/pilot valve system. The thrust supply annulus 220 may supply thrust to all the nozzle 106 and pilot valve 100 systems in the tail section simultaneously. The configuration shown in FIGS. 8 and 9 allow for ongoing and continuous thrust gas supply to the nozzle systems for control by the pilot valve 100.

As indicated above, missile diameter is a significant limitation on the guidance systems carried by a missile. Generally, solid fuel missiles in general with diameters of less than roughly 30 inches have had to depend upon fins to guide the missile. Larger missiles and rockets have used thrust diversion valves in place of fins for guidance. However, conventional thrust valves are of the size and weight that would make them impractical to use for guidance in place of fins on such smaller vehicles having solid fuel and associated high temperature operating environments. This is especially so in the area of solid fueled tactical missiles, which may have a diameter of 10 inches or less.

Figure 11:
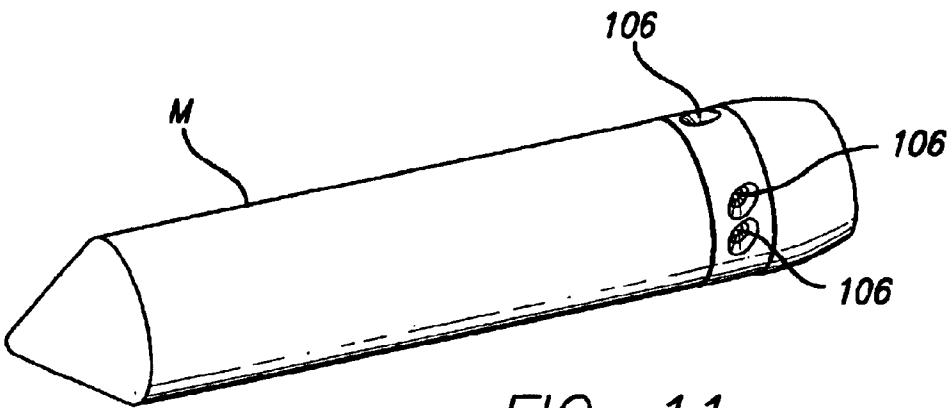
FIG. 11 is a view of a missile incorporating the valve technology of the present invention.

One embodiment of the present thrust valve system is related to a thrust valve system for solid fuel missile guidance that is enclosed in the missile's housing, which is less than 30 inches in diameter. The missile thus would not need fins as its primary steering mechanism. In more detailed aspects of the invention, the missile could have a diameter of less than 10 inches or even less than 7 inches, to provide for air launches by aircraft or to fit in other small launching systems on space, air, ground, or sea vehicles. In one preferred embodiment as shown in FIG. 11, six thrust valves 230 are used and located within the body of the missile M adjacent to its main propellant exhaust port.

As shown in the drawings, the poppet 104 is shown in an open nozzle position in FIGS. 5 and 9 while the poppet is shown in a closed nozzle position in FIGS. 2, 3, and 6–8. In these closed-valve FIGS. 2, 3, and 6–8, the control chamber 102 is best seen.

The novel reaction jet control system concept disclosed herein and shown in FIGS. 7 and 8 is for solid fueled tactical missiles and other propelled craft. Integration of six (6) poppet valves 230 and respective associated electrically driven hot gas pilot valves 100 onto the back end of a production AMRAAM rocket motor is set forth. The valves 230 open and close to divert a portion of the rocket motor propellant gases radially outward from the missile body. The radial components of thrust provide steering authority for the missile. The concept may have uses in other weapon systems such as torpedoes and countermeasures. The concept encompasses several key features including those described below.

A six (6) valve radial thruster assembly (FIGS. 7–9) is integrated with the missile exhaust nozzle provides axial thrust, pitch, roll and yaw control. The valves 230 comprise cylindrical flat faced piston poppets 104 that reciprocate in a bore 142 and seal against flatfaced valve seats 130. The contact area between the piston and the seat is annular, such that the outside diameter of the contacting poppet face is larger than the inside diameter of the valve seat's through hole 184. The annular valve seat contact area 186 provides an effective seal for the hot propellant gases when the piston 104 is in the closed position. By default, the valves 230 are normally in the closed position when no electrical power is supplied to the pilot valve solenoids 118.

Gas pressure from the generator is supplied to the valve seat 130 at all times. Through the action of an electrically driven pilot valve 100, gas can be supplied or released from the opposite side, or control chamber side, of the poppet 104. A differential pressure area exists between either end of the poppet 104 in such a manner that pressure supplied to both ends of the poppet forces the poppet face against the flat seat 130 to close the valves 230. When gas pressure is released from the control chamber 102, the poppet 104 opens to produce radial thrust.

The piston 104 contains at least two graphite piston ring seals 240 (FIG. 2) assembled into rectangular grooves 242 on the outside diameter of the piston 104. The rings 240 contact a smooth cylinder wall 142 and provide a low leakage seal between either end of the poppet 104. The piston rings 240 glide on a thin wall refractory metal sleeve 244 that is shrink fit into the piston housing, or block, 246. In the preferred embodiment, rhenium piston sleeves 244 are fitted to carbon-carbon or phenolic piston housings 246. The sleeves 244 provide a smooth, non-eroding wear surface for the piston rings 240 to glide on. Due to thermal expansion differences between the sleeves 244 and the housing 246, the sleeves 244 are designed to expand into the housing 246 and provide a leak tight interface between the sleeve outside diameter and the housing bore inside diameter. The pistons 104 and seats 130 may be constructed from reinforced carbon-silicon-carbide composite or other suitable materials required by particular applications.

The housing 246 may be assembled into the aft end of the rocket motor chamber and retained by an insulated motor closure 160. In the preferred method, the motor closure 160 is constructed from titanium to reduce weight and is held onto the rocket motor case with a circumferential thread. Radial orientation of the valves 230 relative to the rocket motor can be controlled with an adapter ring (not shown) if required. The piston housing 246 is constructed from non-eroding reinforced structural composite materials such as carbon-carbon or carbonsilicon-carbide. It can also be constructed from ablative reinforced structural composites such as carbon-phenolic or silica-phenolic. The motor closure 160 is insulated from the extreme temperature of the hot gases with carbon-phenolic or silica-phenolic reinforced insulator. Other suitable materials may also be used.

The piston bores 142 may be oriented axially or radially. In one embodiment, the piston bores 142 are oriented axially and parallel to the missile thrust axis to minimize size, weight, and envelope. For such radial bore structures, the associated nozzles may still be disposed radially. Hot gases are transferred from the motor chamber, through the titanium closure 160 and into axial passages in the exhaust nozzle assembly and provide an insulated flow path that prevents overheating of the titanium motor closure. The transfer quills contain O-rings on the outside diameter or may be retained with high temperature epoxy or silicone rubber adhesive.

The aft nozzle 222 (FIG. 9) may be a single ablative phenolic structure that contains an axial thrust exhaust nozzle 250 and six radial nozzles 106 for pitch, yaw and roll control. The nozzle structure may contain axial flow passages for transfer of gas aftward from the rocket motor. These passages may intersect with radially-oriented attitude control nozzles at right angles. The intersection may occur upstream of the nozzle throat, which may have a thin insert of rhenium, carbon-SiC or other suitable non-eroding material to prevent excessive ablation of the throat.

Figure 10:
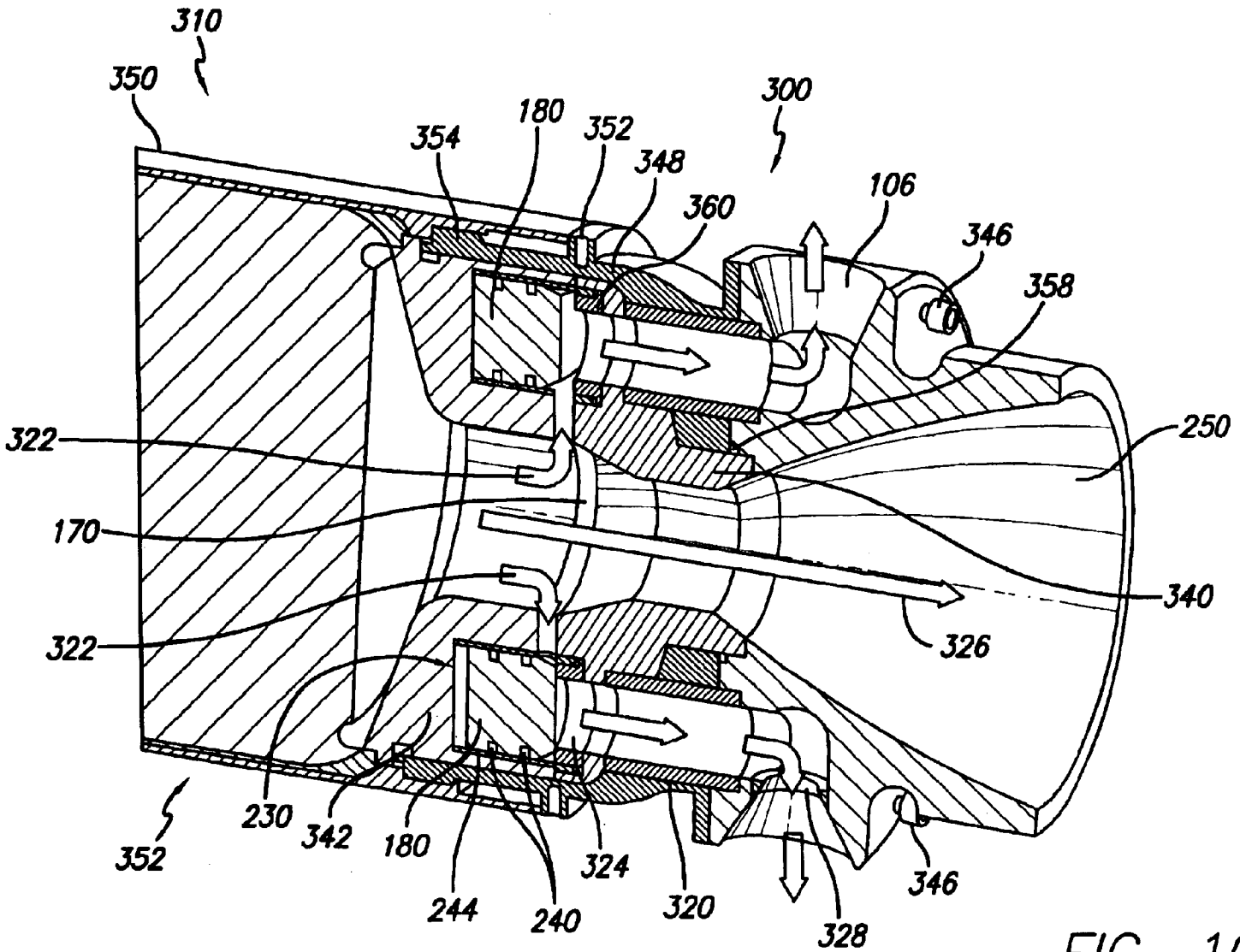
FIG. 10 is a side perspective and half cross sectional view of a tail section of a missile incorporating the pilot valve and lateral thrust valve system of the present invention in an axial configuration.

In FIG. 10, an alternative embodiment of an aft nozzle 300 similar to that as shown in FIG. 9 has the six radial nozzles 106 generally disposed in a geometry similar to that as shown in FIG. 7. As such, the pitch, yaw, and roll control generally remains the same as for the previously described embodiments. However, the valves 230 with its poppet 180 are disposed in an axial arrangement generally parallel to the main axis of the missile or other vehicle. This configuration of the valves 230 demands less radial space so that the valves 230 and the nozzles 106 do not take up space needed for the main thrust nozzle 250. This space-saving configuration is especially useful for smaller, tactical missiles where the use of the valve technology disclosed herein might otherwise displace space necessary for primarily propelling the vehicle 310.

Transfer quills 320 guide the incoming thrust 322 from the valve mouth 324 to the nozzle 106. Thrust 322 is diverted past the poppet 180 in a manner that becomes then parallel but offset from the main thrust plume 326 generated by the burning propellant 332, onto the nozzle throat 328 and ultimately out the nozzle 106. The nozzle throat 328 may be reinforced by a refractory nozzle throat insert 330 to prevent erosion at the nozzle throat and better maintain the integrity of the nozzle 106. The nozzle 250 may be made of phenolic as may be the phenolic insulator 340 which acts in conjunction with the phenolic housing 342 to define the throat 344 or the main nozzle 250. Nozzle attachment bolts 346 serve to attach the phenolic nozzle to the titanium motor closure 348. The titanium motor closure 348 may be threaded via attachment threads 354 onto the main missile body 350 with wrench holes 352 serving as means by which the titanium motor closure 348 may be engaged for threading on the main missile body 350. A gasket 358, such as an exfoliated graphite gasket, may be used to seal the interface between the phenolic nozzle 250, the phenolic insulator 340, and the titanium motor closure 348.

Valve seats 360 may be made of carbon and/or silicon carbide and serve to establish the nozzle inlet mouth 324. The valve seats 360 also define the flat annular area circumscribing the nozzle inlet mouth 324 to engage the flat poppet face 132 of the poppet 180. The operation of the valve 230 is the same as for the other embodiments disclosed herein as such operation does not involve gravity, but only the allocation of thrust pressure on either side of the poppet 180.

The pilot valve assembly 100 that controls gas flow to actuate the piston poppet 104 is comprised of rhenium valve elements captured in structural insulator, and electrically activated against supply pressure using a conventional solenoid 118. The use of phenolic insulator reduces weight and cost. The pilot valve 100 contains a two-stage vent to provide a frictionless seal that isolates the solenoid 118 from pressure and temperature of the hot gas.

The pilot valve elements are comprised of a rhenium ball 110 trapped between opposing conical rhenium valve seats 112, 114. The seats are sealed against their respective housing using exfoliated graphite gaskets. In the pilot valve disclosed herein, EGC grafoil gaskets may be used.

The valve seats 112, 114 may be retained in phenolic housing with the application of axial preload provided by solenoid retention screws or solenoid housing threads. The axial preload compresses the grafoil gaskets beneath the rhenium valve seats 112, 114, and retains the valve elements.

Supply gas pressure may be bled from the annulus 220 upstream of the piston poppet seats 130 and delivered to the inlet 176 of the pilot valve 100. Gas pressure is then fed to the pilot valve ball 110 through a porous zirconia oxide or other filter 174, which is used to trap motor exhaust condensables and particulates that could impede pilot valve function. Hot gas passes through the conical supply seat 112 past the ball 110 and flows radially outward via the port slot 150 to an axially-oriented phenolic quill 154 that transfers control pressure into the control chamber 102 of the main poppet valve 230. The pilot ball 110 acts as a thrust gas pressure gate and is normally pressurized against the opposing valve seat 114 when the solenoid 118 is in the de-energized position. A rhenium plunger 116 affixed to an electric solenoid protrudes through a small close fit hole and contacts the ball 110. The plunger 116 is attached to the solenoid armature that is displaced away from the pole face in the de-energized position.

Electrical power supplied to the solenoid coils from the flight computer or control system (not shown) provides an electromagnetic force to close the armature gap and force the ball 110 off the vent seat 114 and onto the supply seat 112. In this position, the gas supply to the piston poppet 104 is cut off, and the control chamber 102 is opened to radial vent slots 140 that release the piston poppet control chamber pressure to ambient. The pilot valve radial vent housing 144 is constructed of phenolic, which encourages ablation and thermally isolates the solenoid 118 from convection and conduction of heat into the solenoid 118. Venting the control chamber 102 causes the valve 230 to open and produces radial thrust.

Excessive pressure beneath the armature could impede pilot valve function, overheat the solenoid 118, and prevent the main valve 230 from opening. Gas vent pressure is isolated from the solenoid armature by means of the small diametrical clearance between the rhenium plunger 116 and the vent seat 114. A second series of smaller radial vent slots 146 exists between the diametrical clearance gap and the solenoid 118, to assure that all pressure exposed to the solenoid armature is vented to ambient. The two-stage vent eliminates friction associated with direct contacting seals on the solenoid armature plunger 116. Additionally, it reduces static pressure exposed to the solenoid armature and minimizes heat transfer to the solenoid 118.

In operation, the pilot valve 100 receives pulse width modulated commands to alternate movement of the pilot ball 110 from supply seat 112 to vent seat 114. The erosion resistant rhenium pilot ball 110 reciprocates between opposing rhenium seats 112, 114 to pressurize or de-pressurize the control chambers 102 of the axially or radially mounted piston poppets 104. The alternating pressurization and de-pressurization of control chambers opens and closes the poppets 104. The piston poppets reciprocate in rhenium sleeve liners 244 assembled into composite structures 246, enabling a compact, lightweight and low cost means of producing radial thrust pulses for missile directional control.

A sponge like porous filter 174 is bonded into a phenolic cartridge with ablative adhesive to provide a tortuous path for propellant gas contaminants to condense and become trapped prior to entry into a housing containing a ball poppet valve. The conical seats 112, 114 which capture a refractory ball 110, are trapped in a phenolic housing sealed with high density exfoliated graphite gaskets. The phenolic housings are retained by the solenoid housing or retention screws. The solenoid may be threaded or flange mounted. The ball stroke results from the dimensioning scheme of the valve seats and ball, which are machined to close tolerance dimensions. The solenoid stroke is larger than the ball stroke to assure the ball. seals properly on either seat after adjustments to remove assembly clearances are made. The solenoid plunger length is adjusted to remove dimensional stack up clearances when the solenoid is energized to drive the ball 110 against the gas supply seat 112.

With the solenoid de-energized, gas supply pressure forces the ball off the supply seat 112 and seals it against the vent seat 114, which diverts gas to the control chamber 102. Gas supply pressure lifts the ball 110 and pushes on the solenoid plunger 116, which translates the solenoid armature away from the pole face of the electromagnetic coil, thus increasing the armature air gap. Solenoid force is inversely related to the armature air gap. An adjustment to limit the maximum gap provides assurance of adequate force margin at worst case design conditions. Energizing the solenoid 118 to close the air gap forces the ball 110 against the supply seat 112, permitting the control chamber 102 to vent to ambient.

A refractory extension affixed to the solenoid plunger 116 may protrude through a close clearance bore in the phenolic housing that retains the valve seat downstream of the primary vent. A small annulus formed by the close fitting phenolic bore and refractory extension connect to a volume of air beneath the solenoid, which is also vented to ambient through secondary vent holes. The two stage vent design results in negligible pressure force and heat transfer to the solenoid 118.

Other embodiments of the present invention may include the use of a variety of materials that perform similar or the same operations as those set forth herein. Additionally, alternative structures, geometries, and configurations may be used to achieve the present invention.

The embodiments described herein provide one or more advantages in missile control technology, such as including the more reliable operation of divert, attitude, and/or thrust vector control valves for the diversion or use of propellant. Additionally, the flat poppet face 132 in conjunction with the flat nozzle seat 130 enable the valve system 230 to provide better and more reliable valve closure in order to ensure that stray thrust is minimized. The pilot valve system 100 also provides efficient and reliable means by which propellant gas (that by necessity creates a hostile operating environment) may be harnessed for use in the control of a lateral thrust or other thrust diversion.

Note should be taken that the pilot valve 100 and thrust valve 230 do not require sensors or springs in order to operate. This provides a significant advantage in construction and operation as such additional parts are not needed as would be less likely to survive the hot, corrosive thrust gas environment. By exploiting pressure forces, no springs are needed.

While the present invention has been described with reference to a preferred embodiment or to particular embodiments, it will be understood that various changes and additional variations may be made and equivalents may be substituted for elements thereof without departing from the scope of the invention or the inventive concept thereof. In addition, many modifications may be made to adapt a particular situation or material to the teachings of the invention without departing from the essential scope thereof. Therefore, it is intended that the invention not be limited to particular embodiments disclosed herein for carrying it out, but that the invention includes all embodiments falling within the scope of the appended claims.

What is claimed is:

1. A pilot valve for redirecting thrust to control a thrust valve, comprising:

a housing having a supply valve seat and a vent valve seat defining an internal valve chamber;

the supply valve seat defining a thrust inlet opening;

the vent valve seat defining a pressure vent opening;

the valve chamber in communication with the thrust inlet opening, the pressure vent opening, and configured to communicate with the thrust valve;

a valve gate moveable between the supply valve and vent valve seats to selectably seal either the supply valve seat or the vent valve seat; and a valve gate control mechanism operably coupled to the valve gate; whereby when the valve gate is seated in the vent valve seat, thrust pressure is applied to the thrust valve, the thrust being ceased when the valve gate is seated in the supply valve seat, whereupon any residual thrust pressure on the thrust valve is vented through the pressure vent.

2. A pilot valve for redirecting thrust to control a thrust valve as set forth in claim 1, further comprising:

the supply valve seat, the vent valve seat, and the valve gate all being made at least in part of a refractory material.

3. A pilot valve for redirecting thrust to control a thrust valve as set forth in claim 2, wherein the refractory material is selected from the group consisting of rhenium, tungsten, niobium, tantalum, molybdenum, and alloys thereof.

4. A pilot valve for redirecting thrust to control a thrust valve as set forth in claim 1, further comprising:

a vent housing disposed between and spaced apart from the vent valve seat and the valve gate control mechanism to thereby define primary and secondary vents, respectively, the vent housing protecting the valve gate control mechanism from thrust gasses exhausted through the pressure vent.

5. A pilot valve for redirecting thrust to control a thrust valve as set forth in claim 1, wherein the valve gate control mechanism further comprises:

a solenoid; and a rod coupling the valve gate to the solenoid; whereby activation of the solenoid urges the valve gate against the supply valve seat.

6. A pilot valve for redirecting thrust to control a thrust valve as set forth in claim 1, further comprising:

a thrust filter disposed inline with the supply valve seat; whereby thrust gasses transmitted to the supply valve seat are first filtered by the thrust filter to reduce particulates and condensables.

7. The pilot valve for redirecting thrust to control a thrust valve as set forth in claim 1, further comprising:

the housing being constructed of ablative materials.

8. The pilot valve for redirecting thrust to control a thrust valve as set forth in claim 7, further comprising:

the ablative material being phenolic.

9. A pilot valve for redirecting thrust to control a thrust valve, comprising:

a rhenium-based supply valve seat and a rhenium-based vent valve seat defining a rhenium-based valve chamber;

the supply valve seat defining a thrust inlet opening;

the vent valve seat defining a pressure vent opening;

the valve chamber in communication with the thrust inlet opening, the pressure vent thrust opening, and configured to communicate with the thrust valve;

a rhenium-based valve ball moveable between the supply valve and vent valve seats to selectably seal either the supply valve seat or the vent valve seat;

a solenoid operably coupled to the valve ball by a rhenium-based rod such that activation of the solenoid urges the valve ball against the supply valve seat;

a vent housing disposed between and spaced apart from the vent valve seat and the solenoid to thereby define primary and secondary vents, respectively, the vent housing protecting the solenoid from thrust gasses exhausted through the pressure vent; and a thrust filter disposed inline with the supply valve seat such that thrust gasses transmitted to the supply valve seat are first filtered by the thrust filter to reduce particulates and condensables; whereby when the valve ball is seated in the vent valve seat, thrust pressure is applied to the thrust valve, the thrust being ceased when the valve ball is seated in the supply valve seat, whereupon any residual thrust pressure on the thrust valve is vented through the pressure vent.

10. The pilot valve for redirecting thrust to control a thrust valve as set forth in claim 9, further comprising:

the vent housing being constructed of ablative material.

11. The pilot valve for redirecting thrust to control a thrust valve as set forth in claim 10, further comprising:

the ablative material being phenolic.

12. A thrust valve for controllably directing thrust, comprising:

a nozzle having a mouth, a throat, and an annular area around the mouth being generally flat;

a block defining a cylinder;

a poppet confined between the nozzle mouth and the block, the poppet traveling in the cylinder to open and close the nozzle mouth;

the top of the poppet being generally flat and wider than the nozzle mouth, the poppet sealing the nozzle mouth when the poppet top is pressed against the nozzle mouth; and the cylinder configured to communication with a pilot valve that controls pressure between the poppet and the block, pressure applied via the pilot valve urging the poppet against the nozzle mouth; whereby the nozzle may be opened and closed by the pilot valve and thrust is selectably ejected by the thrust valve.

13. A thrust valve for controllably directing thrust as set forth in claim 12, further comprising:

a cylinder lining that lines the cylinder;

the poppet traveling in the cylinder lining to protect the cylinder.

14. A thrust valve for controllably directing thrust as set forth in claim 13, wherein the cylinder lining further comprises a refractory material selected from the group consisting of rhenium, tungsten, niobium, tantalum, molybdenum, and alloys thereof.

15. A thrust valve for controllably directing thrust as set forth in claim 12, wherein the poppet further comprises:

a top bevel mediating a wider poppet body diameter with a narrower poppet top diameter; and a bottom bevel circumscribing a bottom of the poppet to define an annular channel about the poppet when the poppet is seated in the cylinder.

16. A thrust valve for controllably directing thrust as set forth in claim 12, wherein the poppet further comprises:

the poppet defining a piston ring groove circumscribing the poppet and for receiving a ring to enable better sealing about the poppet as it travels in the cylinder.

17. A thrust valve for controllably directing thrust as set forth in claim 12, wherein the poppet further comprises:

rhenium.

18. The thrust valve for controllably directing thrust as set forth in claim 12, further comprising:

the nozzle being constructed of ablative material.

19. The thrust valve for controllably directing thrust as set forth in claim 18, further comprising:

the ablative material being phenolic.

20. A thrust valve for controllably directing thrust, comprising:

a nozzle having a mouth, a throat, and an annular area around the mouth being generally flat;

a block defining a cylinder;

a rhenium-based cylinder lining that lines and protects the cylinder;

a rhenium-based, poppet confined between the nozzle mouth and the block, the poppet traveling in the cylinder lining to open and close the nozzle mouth;

the top of the poppet being generally flat and wider than the nozzle mouth, the poppet sealing the nozzle mouth when the poppet top is pressed against the nozzle mouth;

a top bevel mediating a wider poppet body diameter with a narrower poppet top diameter;

a bottom bevel circumscribing a bottom of the poppet to define an annular channel about the poppet when the poppet is seated in the cylinder;

the poppet defining a piston ring groove circumscribing the poppet and for receiving a ring to enable better sealing about the poppet as it travels in the cylinder;

the cylinder in communication with a pilot valve that controls pressure between the poppet and the block, pressure applied via the pilot valve urging the poppet against the nozzle mouth; whereby the nozzle is opened and closed by the pilot valve's control of the poppet and thrust is selectably ejected by the thrust valve.

21. The thrust valve for controllably directing thrust as set forth in claim 20, further comprising:

the nozzle being constructed of ablative material.

22. The thrust valve for controllably directing thrust as set forth in claim 21, further comprising:

the ablative material being phenoic.

23. A thrust valve system, comprising:

a thrust valve having a poppet traveling in a cylinder;

a pilot valve in communication with the cylinder and a source of thrust;

the pilot valve controlling operation of the poppet by controlling thrust pressure between the poppet and the cylinder, the operation of the poppet controlling the operation of the thrust valve; whereby thrust is diverted by the pilot valve to control the thrust valve.

24. A thrust valve system as set forth in claim 23, wherein the thrust valve further comprises:

a nozzle having a mouth, a throat, and an annular area around the mouth being generally flat;

a rhenium-based cylinder lining that lines and protects the cylinder;

the poppet being a rhenium-based poppet confined between the nozzle mouth and the block, the poppet traveling in the cylinder lining to open and close the nozzle mouth;

the top of the poppet being generally flat and wider than the nozzle mouth, the poppet sealing the nozzle mouth when the poppet top is pressed against the nozzle mouth;

a top bevel mediating a wider poppet body diameter with a narrower poppet top diameter;

a bottom bevel circumscribing a bottom of the poppet to define an annular channel about the poppet when the poppet is seated in the cylinder;

the poppet defining a piston ring groove circumscribing the poppet and for receiving a ring to enable better sealing about the poppet as it travels in the cylinder;

the cylinder configured to communicate with a pilot valve that controls pressure between the poppet and the block, pressure applied via the pilot valve urging the poppet against the nozzle mouth; whereby the nozzle is opened and closed by the pilot valve's control of the poppet and thrust may be selectably ejected by the thrust valve.

25. A thrust valve system as set forth in claim 23, wherein the pilot valve further comprises:

a rhenium-based supply valve seat and a rhenium-based vent valve seat defining a rhenium-based valve chamber;

the supply valve seat defining a thrust inlet opening;

the vent valve seat defining a pressure vent opening;

the valve chamber in fluid communication with the thrust inlet, the thrust valve, and the pressure vent;

a rhenium-based valve ball moveable between the supply valve and vent valve seats to selectably seal either the supply valve seat or the vent valve seat;

a solenoid operably coupled to the valve ball by a rhenium-based rod such that activation of the solenoid urges the valve ball against the supply valve seat;

a vent housing disposed between and spaced apart from the vent valve seat and the solenoid to thereby define primary and secondary vents, respectively, the vent housing protecting the solenoid from thrust gasses exhausted through the pressure vent; and a thrust filter disposed inline with the supply valve seat such that thrust gasses transmitted to the supply valve seat are first filtered by the thrust filter to reduce particulates and condensables; whereby when the valve ball is seated in the vent valve seat, thrust pressure is applied to the thrust valve, the thrust being ceased when the valve ball is seated in the supply valve seat, whereupon any residual thrust pressure on the thrust valve is vented through the pressure vent.

26. The thrust valve system as set forth in claim 23, further comprising:

the cylinder defined by a housing constructed of ablative material.

27. The thrust valve system as set forth in claim 26, further comprising:

the ablative material being phenolic.

28. A directional control system for a thrust-based vehicle, comprising:

a first pair of thrust valves coaxially and oppositely opposed to one another, the coaxial axis between the first pair of thrust valves being generally coplanar with and generally perpendicular to a longitudinal axis of the thrust-based vehicle such that spin is applied to the vehicle when one or both of the first pair of thrust valves fire;

a second pair of thrust valves coaxially and oppositely opposed to one another, the coaxial axis between the second pair of thrust valves being generally perpendicular to the coaxial axis of the first pair of thrust valves, the coaxial axis between the second pair of thrust valves being generally perpendicular to but offset a first distance from and not coplanar with the longitudinal axis of the vehicle such that spin is applied to the vehicle when one of the second pair of thrust valves fires;

a third pair of thrust valves coaxially and oppositely opposed to one another, the coaxial axis between the third pair of thrust valves being generally perpendicular to the coaxial axis of the first pair of thrust valves and being generally parallel to the coaxial axis of the second pair of thrust valves, the coaxial axis between the third pair of thrust valves being generally perpendicular to but offset the first distance from and not coplanar with the longitudinal axis of the vehicle such that spin is applied to the vehicle when one of the third pair of thrust valves fires; and the first, second, and third pairs of thrust valves being generally coplanar; whereby pitch, yaw and roll of the thrust-based vehicle is controlled by selectable operation of individuals ones of the thrust valves of the first, second, and third pairs of thrust valves.

29. The directional control system for a thrust-based vehicle as set forth in claim 28, further comprising:

at least one of said valves constructed of ablative material.

30. The directional control system for a thrust-based vehicle as set forth in claim 29, further comprising:

the ablative material being phenolic.

31. A directional control system for a thrust-based vehicle having a longitudinal axis, comprising:

a first pair of coplanar thrust valves oppositely opposed to one another, the first pair of coplanar thrust valves having corresponding axes that are generally parallel to the vehicle's longitudinal axis, the plane shared between the first pair of thrust valves being generally coplanar with the longitudinal axis of the thrust-based vehicle such that spin is applied to the vehicle when one or both of the first pair of thrust valves fire;

a second pair of coplanar thrust valves oppositely opposed to one another, the second pair of coplanar thrust valves having corresponding axes that are generally parallel to the vehicle's longitudinal axis, the plane shared between the second pair of thrust valves being generally perpendicular to the plane shared between the first pair of thrust valves and generally offset a first distance from and not coplanar with the longitudinal axis of the vehicle such that spin is applied to the vehicle when one of the second pair of thrust valves fires;

a third pair of coplanar thrust valves oppositely opposed to one another, the third pair of coplanar thrust valves having corresponding axes that are generally parallel to the vehicle's longitudinal axis, the plane shared between the third pair of thrust valves being generally perpendicular to the plane shared between the first pair of thrust valves, being generally parallel to the plane shared between the second pair of thrust valves, and being generally offset the first distance from and not coplanar with the longitudinal axis of the vehicle such that spin is applied to the vehicle when one of the third pair of thrust valves fires; and the first, second, and third pairs of thrust valves being generally coplanar; whereby pitch, yaw and roll of the thrust-based vehicle is controlled by selectable operation of individual ones of the thrust valves of the first, second, and third pairs of thrust valves.

32. The directional control system for a thrust-based vehicle having a longitudinal axis as set forth in claim 31, further comprising:

at least one of said valves constructed of ablative material.

33. The directional control system for a thrust-based vehicle having a longitudinal axis as set forth in claim 32, further comprising:

the ablative material being phenolic.

34. A valve system for use in a missile, the valve system comprising:

a thrust valve having a piston for diverting hot propellant gas; and a pilot valve in communication with the thrust valve, the pilot valve controlling flow of the hot propellant gas beneath the piston to control operation of the thrust valve.

35. A valve system for use in a missile as set forth in claim 34, wherein the pilot valve further comprises:

a housing having a supply valve seat and a vent valve seat defining an internal valve chamber;

the supply valve seat defining a thrust inlet opening;

the vent valve seat defining a pressure vent opening;

the valve chamber in communication with the thrust inlet, the thrust valve, and the pressure vent;

a valve gate moveable between the supply valve and vent valve seats to selectably seal either the supply valve seat or the vent valve seat; and a valve gate control mechanism operably coupled to the valve gate; whereby when the valve gate is seated in the vent valve seat thrust pressure is applied to the thrust valve, the thrust being ceased when the valve gate is seated in the supply valve seat, whereupon any residual thrust pressure on the thrust valve is vented through the pressure vent.

36. A valve system for use in a missile as set forth in claim 35, further comprising:

the supply valve seat, the vent valve seat, and the valve gate all being made at least in part of a refractory material.

37. A valve system for use in a missile as set forth in claim 35, wherein the refractory material is selected from the group consisting of rhenium, tungsten, niobium, tantalum, molybdenum, and alloys thereof.

38. A valve system for use in a missile as set forth in claim 35, further comprising:

a vent housing disposed between and spaced apart from the vent valve seat and the valve gate control mechanism to thereby define primary and secondary vents, respectively, the vent housing protecting the valve gate control mechanism from thrust gasses exhausted through the pressure vent.

39. A valve system for use in a missile as set forth in claim 35, wherein the valve gate control mechanism further comprises:

a solenoid; and a rod coupling the valve gate to the solenoid; whereby activation of the solenoid urges the valve gate against the supply valve seat.

40. A valve system for use in a missile as set forth in claim 35, further comprising:

a thrust filter disposed inline with the supply valve seat; whereby thrust gasses transmitted to the supply valve seat are first filtered by the thrust filter to reduce particulates and condensables.

41. The missile as set forth in claim 34, further comprising:

the housing being constructed of ablative material.

42. The missile as set forth in claim 41, further comprising:

the ablative material being phenolic.

* * * * *